US010139089B2

(12) United States Patent
Niedermeier et al.

(10) Patent No.: US 10,139,089 B2
(45) Date of Patent: Nov. 27, 2018

(54) LAMP

(71) Applicant: OSRAM GmbH, Munich (DE)

(72) Inventors: Peter Niedermeier, Munich (DE); Jozsef Szekely, Weissenhorn (DE)

(73) Assignee: OSRAM GMBH, Munich (DE)

( * ) Notice: Subject to any disclaimer, the term of this patent is extended or adjusted under 35 U.S.C. 154(b) by 137 days.

(21) Appl. No.: 14/829,666

(22) Filed: Aug. 19, 2015

(65) Prior Publication Data

US 2016/0061427 A1 Mar. 3, 2016

(30) Foreign Application Priority Data

Aug. 26, 2014 (DE) ..... 20 2014 006 966 U

(51) Int. Cl.

| | |
|---|---|
| ***F21V 23/00*** | (2015.01) |
| ***F21V 23/02*** | (2006.01) |
| ***F21V 29/00*** | (2015.01) |
| ***F21V 29/508*** | (2015.01) |
| ***F21K 9/27*** | (2016.01) |
| *F21Y 115/10* | (2016.01) |

(52) U.S. Cl.

CPC ..... *F21V 23/005* (2013.01); *F21K 9/27* (2016.08); *F21V 23/02* (2013.01); *F21V 29/002* (2013.01); *F21V 29/508* (2015.01); *F21Y 2115/10* (2016.08)

(58) Field of Classification Search

CPC ..... F21V 23/005; F21V 29/508; F21V 23/02; F21V 29/002; F21K 9/27

USPC ..... 362/218

See application file for complete search history.

(56) References Cited

U.S. PATENT DOCUMENTS

2005/0264472 A1* 12/2005 Rast ..... G09G 3/14 345/30

2015/0077001 A1* 3/2015 Takahashi ..... H05B 33/0803 315/193

FOREIGN PATENT DOCUMENTS

WO 2013127557 A1 9/2013

* cited by examiner

*Primary Examiner* — Andrew Coughlin
*Assistant Examiner* — Meghan Ulanday
(74) *Attorney, Agent, or Firm* — Viering Jentschura & Partner MBB

(57) ABSTRACT

In various embodiments, a lamp is provided. The lamp may include two mutually opposite end sections, which each form an electrical contact of the lamp. In each case at least one semiconductor light source is arranged in the region of the end sections. The lamp has an operating apparatus for the semiconductor light sources. The operating apparatus has electrical components, which are arranged in the region of a first section of the lamp, and the operating apparatus has at least one further electrical component, which is arranged in the region of the second end section of the lamp.

12 Claims, 3 Drawing Sheets

LAMP

CROSS-REFERENCE TO RELATED APPLICATION

This application claims priority to German Patent Application Serial No. 20 2014 006 966.2, which was filed Aug. 26, 2014, and is incorporated herein by reference in its entirety.

TECHNICAL FIELD

Various embodiments relate generally to a lamp.

BACKGROUND

Such a lamp is disclosed, for example, in the laid-open specification WO 2013/127557 A1. Said publication describes a so-called double-end tubular lamp including two mutually opposite end sections, which each form an electrical contact of the lamp. In each case at least one semiconductor light source is arranged in the region of the end sections, and the lamp has an operating apparatus for the semiconductor light sources.

SUMMARY

In various embodiments, a lamp is provided. The lamp may include two mutually opposite end sections, which each form an electrical contact of the lamp. In each case at least one semiconductor light source is arranged in the region of the end sections. The lamp has an operating apparatus for the semiconductor light sources. The operating apparatus has electrical components, which are arranged in the region of a first section of the lamp, and the operating apparatus has at least one further electrical component, which is arranged in the region of the second end section of the lamp.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
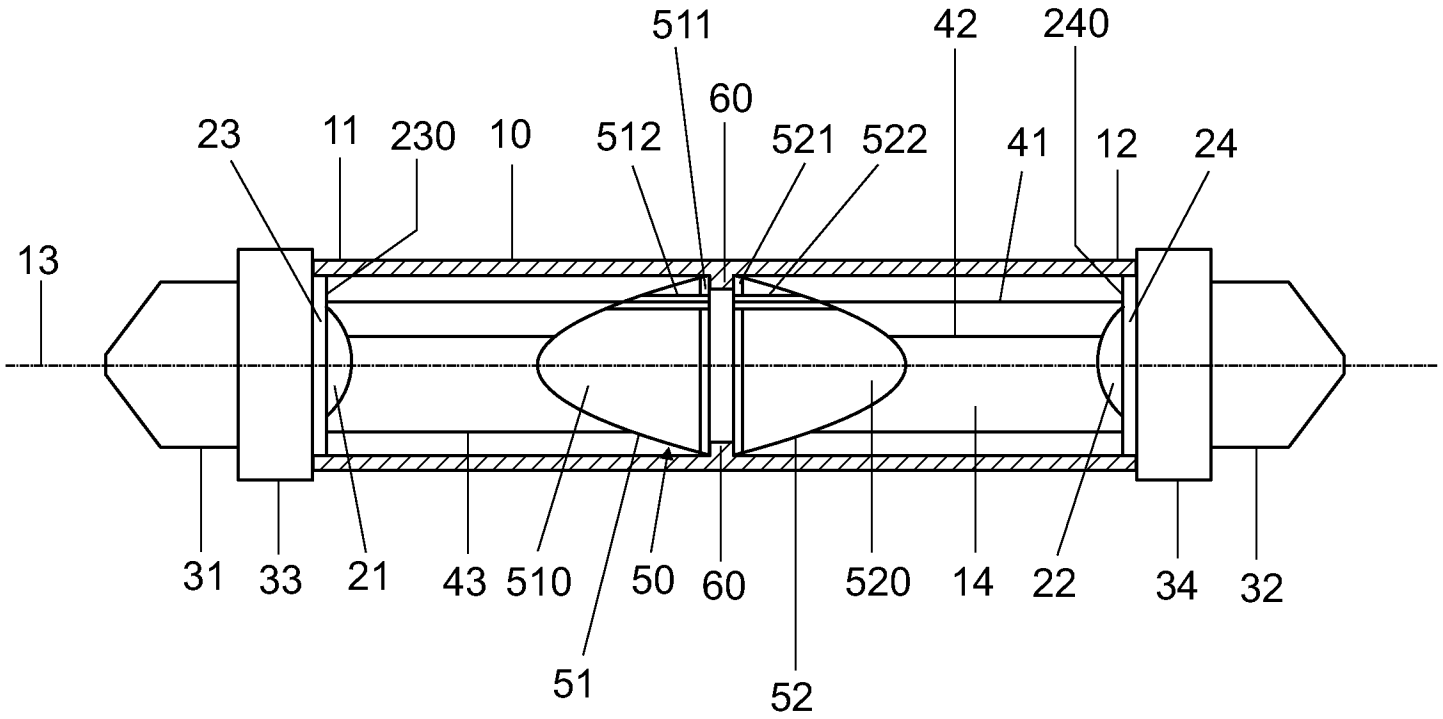
FIG. 1 shows a side view of a lamp according to various embodiments corresponding to a first embodiment in a schematic, partially sectioned illustration.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments provide a lamp of the generic type which enables improved cooling of the operating apparatus.

In various embodiments, a lamp is in the form of a so-called double-end tubular lamp. That is to say that the lamp according to various embodiments has two mutually opposite end sections, which each form an electrical contact of the lamp. In each case at least one semiconductor light source is arranged in the region of the end sections of the lamp according to various embodiments. In addition, the lamp according to various embodiments is provided with an operating apparatus for the semiconductor light sources. In accordance with various embodiments, the operating apparatus has electrical components, which are arranged in the region of a first end section of the lamp, and at least one further electrical component, which is arranged in the region of the second end section of the lamp.

Owing to the abovementioned division of the components of the operating apparatus, the cooling of said operating apparatus is improved because the heat generated by the electrical components of the operating apparatus can be dissipated over both end sections of the lamp according to various embodiments.

The operating apparatus of the lamp according to various embodiments may be in the form of a chopper regulator, and the at least one further component may be an inductive component part of the chopper regulator. As a result, physical separation of the component which is subject to the greatest thermal load, namely the at least one inductive component part of the chopper regulator, from other component parts of the chopper regulator is made possible, and thus the cooling of the operating apparatus may be overall improved.

Chopper controllers are converters which, with the aid of a periodically switching electronic switch and at least one storage element, perform a voltage or current conversion and may be used for supplying voltage or current to electrical devices. The chopper regulator of the lamp according to various embodiments may be in the form of a step-down converter, which provides the voltages and currents required for operating the semiconductor light sources from the mains voltage, e.g. the vehicle electrical distribution system voltage of a motor vehicle.

In various embodiments, only the at least one inductive component part of the chopper regulator is arranged in the region of the second end section of the lamp and all of the rest of the component parts of the chopper regulator are arranged in the region of the first end section of the lamp. As a result, a high degree of efficiency of the chopper regulator and a low level of radio interference by the chopper regulator are achieved because, with the exception of the at least one inductive component part, all of the component parts of the chopper regulator can be connected to one another by short lines. Only one relatively long line is required for connecting the at least one inductive component part of the chopper regulator to the other component parts of the chopper regulator. As a result, the performance of the chopper regulator is not impaired.

The lamp according to various embodiments may have a first printed circuit board, which is arranged in the region of the first end section of the lamp and is populated with electrical components of the operating apparatus, and a second printed circuit board, which is arranged in the region of the second end section of the lamp and is populated with at least one further component of the operating apparatus. The printed circuit boards enable a space-saving arrangement and simple fitting of the components of the operating apparatus in the lamp. In various embodiments, the printed circuit boards populated with the components of the operating apparatus can be fixed on the respective end section of the lamp by cement or other fastening means, for example.

In various embodiments, the at least one semiconductor light source arranged in the region of the first end section of the lamp according to various embodiments may be fitted on a surface of the first printed circuit board, and the at least one semiconductor light source arranged in the region of the second end section of the lamp according to various embodiments may be fitted on a surface of the second printed circuit board. As a result, the semiconductor light sources can be fitted and connected to the chopper regulator in a simple manner.

In various embodiments, the surfaces of the printed circuit boards which are populated with the semiconductor light sources face one another and may be oriented perpendicular to a longitudinal axis of the lamp according to the invention. As a result, the light emitted by the semiconductor light sources can be coupled into a rod-shaped fiberoptic conductor efficiently over its ends, said fiberoptic conductor being positioned in the interspace between the semiconductor light sources and being formed as part of the lamp according to various embodiments.

The first printed circuit board may be coupled thermally to the first end section of the lamp according to various embodiments, and the second printed circuit board may be coupled thermally to the second end section of the lamp according to various embodiments. As a result, the heat generated by the components of the operating apparatus and by the semiconductor light sources can be dissipated to the surrounding environment efficiently via the end sections of the lamp according to various embodiments and e.g. via the electrical contacts of the lamp according to various embodiments.

The lamp according to various embodiments may be in the form of a vehicle lamp, which is used for illuminating the vehicle interior or for number plate lighting.

Figure 3:
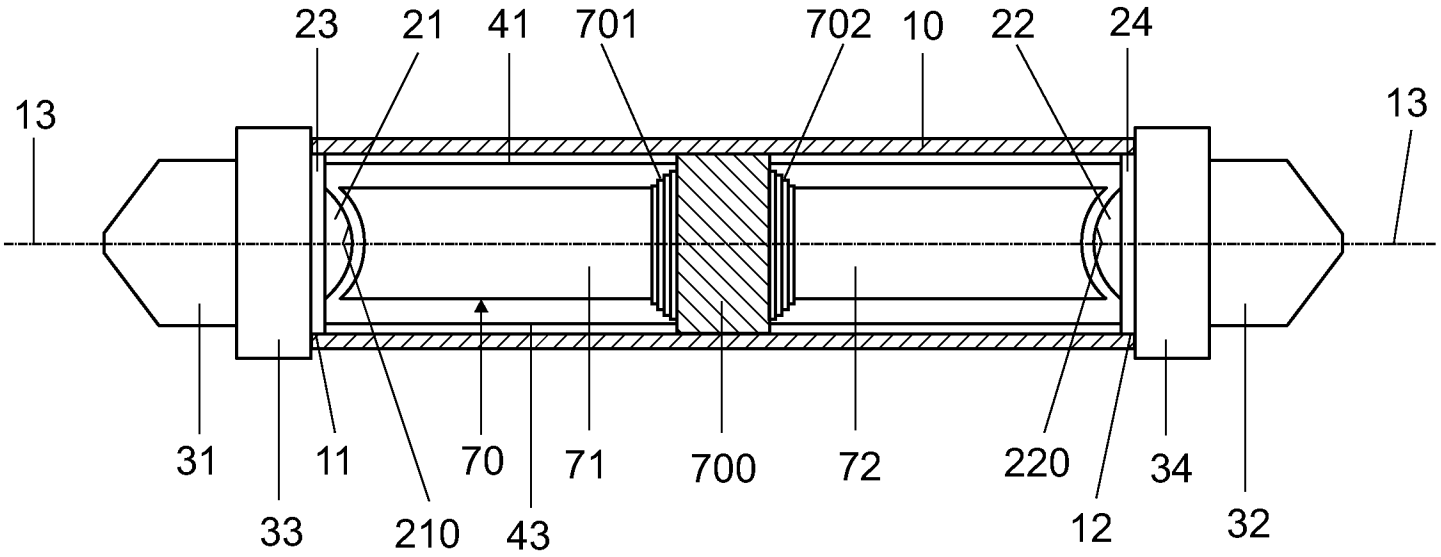
FIG. 3 shows a side view of a lamp according to various embodiments corresponding to a second embodiment in a schematic, partially sectioned illustration.

The lamps depicted in FIG. 1 and FIG. 3 in accordance with various embodiments are each compatible with a vehicle incandescent lamp of the double-ended tubular type of the category C10W, which is used, for example, in motor vehicles for interior lighting and is intended for operation on the vehicle electrical distribution system voltage of the motor vehicle.

The lamp in accordance with the first embodiment depicted in FIG. 1 has a tubular, circular-cylindrical lamp vessel 10 including or essentially consisting of transparent glass or transparent plastic and two semiconductor light sources in the form of light-emitting diode chips 21, 22 arranged in the interior 14 of the lamp vessel, in each case one of said semiconductor light sources being arranged at each end 11, 12 of the lamp vessel 10. The light-emitting diode chips 21, 22 are each arranged on a surface of a printed circuit board 23 and 24, respectively, in the form of a circular disk, which surface is oriented perpendicular to the tube axis 13 of the lamp vessel 10. The tube axis 13 of the lamp vessel 10 is identical to the longitudinal axis of the lamp. The light-emitting diode chips 21, 22 are each fitted on the side facing the interior 14 of the lamp vessel 10, on the surface 230 or 240 of the printed circuit board 23 or 24 and emit white light during operation.

The ends of the tubular lamp vessel 10 are sealed by two metallic base sleeves 32, 32, which are rotationally symmetrical with respect to the longitudinal axis 13 and each form an end section and an electrical contact of the lamp. The first metallic base sleeve 31 and the first printed circuit board 23 are fixed at the first end 11 of the lamp vessel 10 by a first plastic ring 33. The second metallic sleeve 32 and the second printed circuit board 24 are fixed at the second end 12 of the lamp vessel 10 by a second plastic ring 34. The printed circuit boards 23, 24 rest on the respective base sleeve 31 or 32 so that there is thermal coupling between the printed circuit boards 23, 24 and the component parts fixed thereon with respect to the respective metallic base sleeve 31 or 32.

Figure 2:
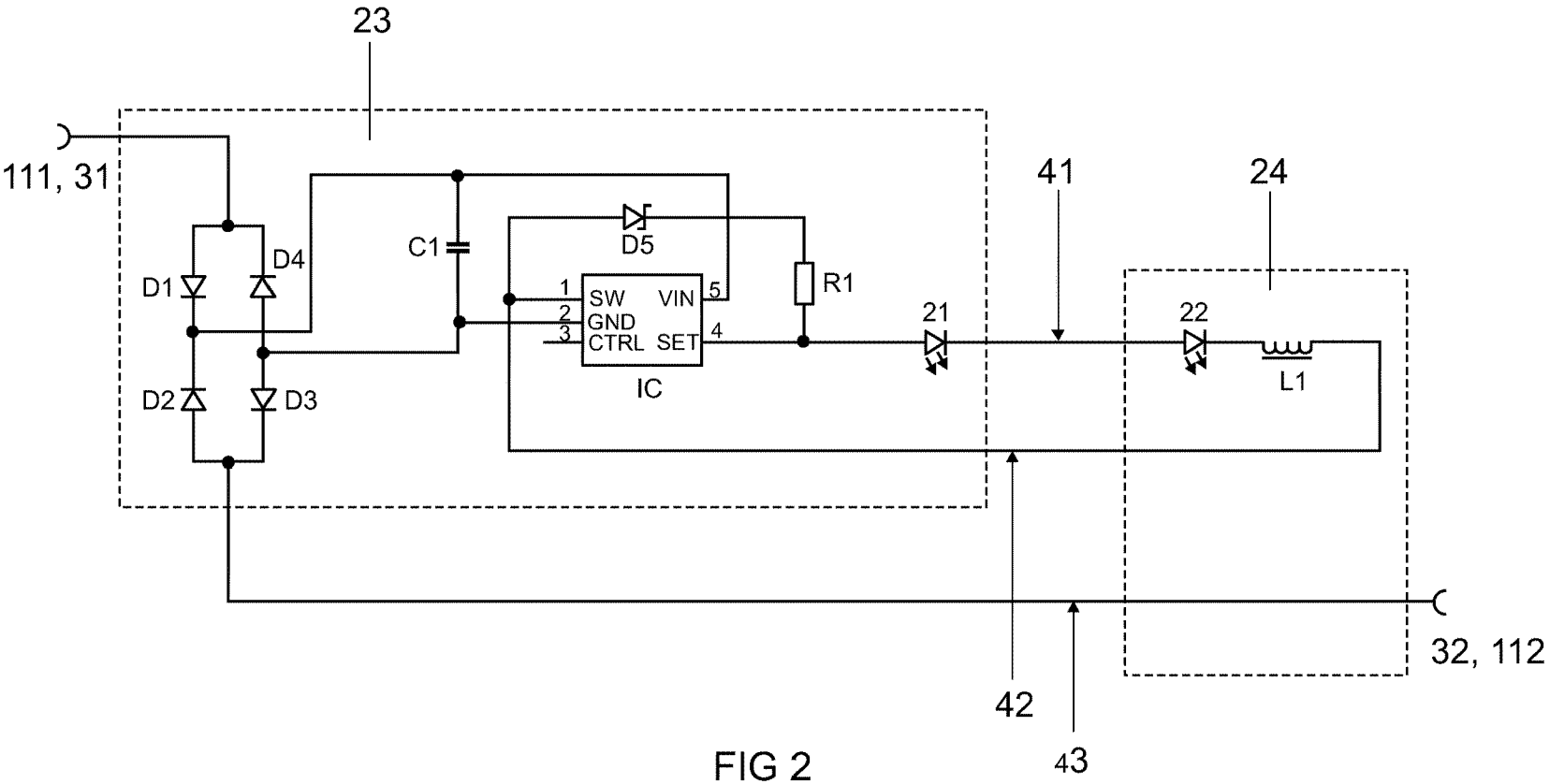
FIG. 2 shows a sketched circuit diagram of the operating apparatus of the lamp according to various embodiments corresponding to various embodiments.

The lamp has an operating apparatus for the two semiconductor light sources or light-emitting diode chips 21, 22. This operating apparatus is in the form of a chopper regulator in the form of a step-down converter. The operating apparatus has four diodes D1, D2, D3, D4, which are interconnected to form a bridge rectifier, a capacitor C1, an ohmic resistor R1, an inductive component part L1 in the form of an inductor, a Zener diode D5 and an integrated circuit IC. The integrated circuit IC has the designation AL8807 and, together with the capacitor C1, the inductor L1, the ohmic resistor R1 and the Zener diode D5, forms a step-down converter for operation of the two series-connected light-emitting diode chips 21, 22. The bridge rectifier formed by the four diodes D1, D2, D3, D4 acts as protection against reversal of the connections 111, 112 when connecting the vehicle electrical distribution system of the motor vehicle to the lamp or operating apparatus. FIG. 2 shows schematically a sketched circuit diagram of the operating device. The connections 111, 112 of the operating apparatus are formed by the metallic base sleeves 31, 32 of the lamp.

The diodes D1, D2, D3, D4, the Zener diode D5, the capacitor C1, the integrated circuit IC and the ohmic resistor R1 are arranged, together with the first light-emitting diode chip 21, on the surface of the first printed circuit board 23. The abovementioned components of the operating apparatus are distributed over both sides of the printed circuit board 23. The inductive component part L1 of the operating apparatus is arranged, together with the second light-emitting diode chip 22, on the surface of the second printed circuit board 24. The second light-emitting diode chip 22 is fitted on that side of the second printed circuit board 24 which faces the lamp vessel 10, while the inductive component part L1 is fitted on that side of the second printed circuit board 24 which faces away from the lamp vessel 10. FIG. 2 shows the printed circuit boards 23, 24 schematically by dashed lines. With the exception of the inductive component part L1, which is fitted on the second printed circuit board 24, all other components of the operating apparatus are fitted on the first printed circuit board 23.

The two light-emitting diode chips 21, 22 are connected in series and are connected to one another by a first power supply line 41. The inductive component part L1 is connected to connection SW of the integrated circuit IC via a second power supply line 42. The second electrical connection 112 of the lamp or of the operating apparatus is connected to a voltage input of the bridge rectifier D1, D2, D3, D4 via a third power supply line 43. The first connection 111 of the lamp or of the operating apparatus is connected to the other voltage input of the bridge rectifier D1, D2, D3, D4.

A reflector 50 which consists of two mirror-symmetrical reflector sections 51, 52 is arranged centrally in the interior 14 of the lamp vessel 10.

Each of the two reflector sections 51, 52 is in the form of a paraboloid, whose axis of rotation is in each case in the tube axis 13 of the lamp vessel 10. The apex of the first parabolic reflector section 51 faces the first light-emitting diode chip 21, which is arranged in the first end 11 of the lamp vessel 10, and the apex of the second parabolic reflector section 52 faces the second light-emitting diode chip 22, which is arranged in the second end 12 of the lamp vessel 10. In each case one light-reflecting reflective layer 510, 520 is applied to the outer surface of the parabolic reflector sections 51, 52. The reflector sections 51, 52 consist of plastic and their reflective surfaces 510, 520 are formed by an aluminum coating of the reflector sections 51, 52. The reflective surfaces 510, 520 can be faceted.

Three projections 60 attached to the inner side of the wall of the discharge vessel 10 and protruding into the interior 14 of the lamp vessel 10 are used for holding the reflector 50 or its two reflector sections 51, 52. The projections 60 are arranged in the center of the lamp vessel 10 along a circumference of the lateral surface of the lamp vessel 10. In order to fit the reflector 50, the first reflector section 51 is introduced into the lamp vessel 10 via the first end 11 in such a way that the apex of the parabolic first reflector section 51 is directed towards the first end 11 of the lamp vessel 10 and the rim 511 of the first reflector section 51 rests on one side of the projections 60. The rim 511 of the first reflector section 51 is fixed to the projections 60 by adhesive or a clamping fit. Similarly thereto, the second reflector section 52 is introduced into the lamp vessel 10 via the second end 12 in such a way that the apex of the parabolic second reflector section 52 is directed towards the second end 12 of the lamp vessel 10 and the rim 521 of the second reflector section 52 rests on the other side of the projections 60. The rim 521 of the second reflector section 52 is fixed on the projections 60 by adhesive or a clamping fit. The two reflector sections 51, 52 therefore rest on mutually opposite sides of the projections 60. The outer diameter of the rims 511, 521 of the reflector sections 51, 52 corresponds to the inner diameter of the lamp vessel 10. The reflector sections 51, 52 each have three cutouts 512, 522 formed as a depression in their surface for passing through the three power supply lines 41, 42, 43. These depressions 512, 522 are arranged close to the wall of the lamp vessel 10. The power supply lines 41, 42, 43 are electrically insulated from the reflector 50.

FIG. 3 shows a schematic illustration of a lamp in accordance with the second embodiment. The lamp in accordance with the second embodiment differs from the lamp in accordance with the first embodiment only in that the lamp in accordance with the second embodiment has a fiberoptic conductor 70 instead of the reflector 50. In all other details the lamps in accordance with the first and second embodiments correspond to one another. Therefore, the same reference symbols are used for identical components of the lamps in FIG. 1 to FIG. 3 and reference is made to the description of the first embodiment for the description of said components. Therefore, now only the distinguishing features of the lamp in accordance with the second embodiment will be explained in more detail below.

A fiberoptic conductor 70, which is rotationally symmetrical with respect to the tube axis 13 of the lamp vessel 10, is arranged in the interior of the lamp vessel 10. The fiberoptic conductor 70 has a central, cylindrical fiberoptic conductor section 700, which is positioned centrally between the two light-emitting diode chips 21, 22, the lateral surface of said fiberoptic conductor section resting on the inner wall of the lamp vessel 10 and being connected to the lamp vessel 10. In each case one fiberoptic conductor section 701 or 702 in the form of a truncated cone is formed integrally on the two end sides of the central, cylindrical fiberoptic conductor section 700. The lateral surfaces of the fiberoptic conductor sections 701, 702 in the form of a truncated cone each have a stepped surface structure. A first circular-cylindrical fiberoptic conductor section 71, whose diameter is less than the diameter of the central, cylindrical fiberoptic conductor section 700 and which extends in the direction of the first light-emitting diode chip 21, is formed integrally on the truncated cone tip of the first fiberoptic conductor section 701 in the form of a truncated cone. That end of the first circular-cylindrical fiberoptic conductor section 71 which faces the first light-emitting diode chip 21 is arranged at a short distance from the first light-emitting diode chip 21 and its shape is matched to the shape of the light-emitting surface 210 of the first light-emitting diode chip 21. A second circular-cylindrical fiberoptic conductor section 72, whose diameter is less than the diameter of the central, cylindrical fiberoptic conductor section 700 and which extends in the direction of the second light-emitting diode chip 22, is formed integrally on the truncated cone tip of the second fiberoptic conductor section 702 in the form of a truncated cone. That end of the second circular-cylindrical fiberoptic conductor section 72 which faces the second light-emitting diode chip 22 is arranged at a short distance from the second light-emitting diode chip 22 and its shape is matched to the shape of the light-emitting surface 220 of the second light-emitting diode chip 22. The lateral surfaces of the first circular-cylindrical fiberoptic conductor section 71 and the second circular-cylindrical fiberoptic conductor section 72 are formed with total internal reflection, for example by an aluminum coating. The light coupled into the fiberoptic conductor 70 can therefore leave the fiberoptic conductor 70 only via the stepped, light-scattering surface of the fiberoptic conductor sections 701, 702 in the form of truncated cones and via the lateral surface of the central cylindrical fiberoptic conductor section 700, which is connected to the wall of the lamp vessel 10.

The three power supply lines 41, 42, 43 are passed through one or more apertures in the central cylindrical fiberoptic conductor section 700. FIG. 3 shows, for reasons of clarity, only two 41, 43 of the three power supply lines 41, 42, 43.

Various embodiments are not restricted to the embodiments explained in more detail above.

By way of example, organic light-emitting diodes, superluminescent diodes or laser diodes, in each case with or without phosphor can also be used instead of the light-emitting diode chips in order to generate white light. In addition, the lamp vessel can be provided with a matt or colored coating or a phosphor coating in order to generate more homogeneous or colored light. In addition, it is also possible to dispense with the lamp vessel and instead to use the fiberoptic conductor or another structure for holding the base sleeves and the printed circuit boards.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lamp, comprising:

a first end section provided in a first end section region and a second end section provided in a second end section region, wherein the first end section and the second end section are diametrically disposed, each respective end section forming an electrical contact of the lamp, wherein at least one semiconductor light source is arranged in each respective end section region, and wherein the lamp has an operating apparatus for the semiconductor light sources;

wherein the operating apparatus has electrical components arranged in the first end section region of the lamp, and the operating apparatus has at least one further electrical component arranged in the second end section region of the lamp; and wherein the operating apparatus is a chopper regulator, and the at least one further electrical component of the operating apparatus is at least one inductive component of the chopper regulator.

2. The lamp of claim 1, wherein the at least one inductive component is the only electrical component arranged in the second end section region of the lamp.

3. The lamp of claim 1, wherein the lamp has a first printed circuit board arranged in first end section region of the lamp and is populated with the electrical components of the operating apparatus, and has a second printed circuit board arranged in the second end section region of the lamp and is populated with the at least one further electrical component of the operating apparatus.

4. The lamp of claim 3, wherein the first printed circuit board is thermally coupled to the first end section, and the second printed circuit board is thermally coupled to the second end section.

5. The lamp of claim 1, wherein the at least one semiconductor light source arranged in the first end section region is fitted on a surface of a first printed circuit board, and the at least one semiconductor light source arranged in the second end section region is fitted on a surface of a second printed circuit board.

6. The lamp of claim 5, wherein the surfaces of the printed circuit boards populated with the semiconductor light sources face one another and are oriented perpendicular to a longitudinal axis of the lamp.

7. A lamp, comprising:

a first end section diametrically disposed to a second end section, each respective end section forming an electrical contact of the lamp, wherein at least one semiconductor light source is arranged in each respective end section;

an operating apparatus for the semiconductor light sources, the operating apparatus comprising:

electrical components arranged in a first section of the lamp; and at least one further electrical component arranged in the second end section of the lamp;

wherein the operating apparatus is a chopper regulator, and the at least one further electrical component of the operating apparatus is at least one inductive component of the chopper regulator;

wherein the at least one inductive component is the only electrical component arranged in the region of the second end section of the lamp.

8. The lamp of claim 7, wherein the lamp has a first printed circuit board arranged in the first end section of the lamp and is populated with the electrical components of the operating apparatus, and has a second printed circuit board arranged in the second end section of the lamp and is populated with the at least one further electrical component of the operating apparatus.

9. The lamp of claim 7, wherein the at least one semiconductor light source arranged in the first end section is fitted on a surface of a first printed circuit board, and the at least one semiconductor light source arranged in the second end section is fitted on a surface of a second printed circuit board.

10. The lamp of claim 9, wherein the surfaces of the printed circuit boards populated with the semiconductor light sources face one another and are oriented perpendicular to a longitudinal axis of the lamp.

11. The lamp of claim 8, wherein the first printed circuit board is thermally coupled to the first end section, and the second printed circuit board is thermally coupled to the second end section.

12. A lamp, comprising:

a first end section provided in a first end section region and a second end section provided in a second end section region, wherein the first end section and the second end section are diametrically disposed, each respective end section forming an electrical contact of the lamp, wherein at least one semiconductor light source is arranged in each respective end section region, and wherein the lamp has an operating apparatus for the semiconductor light sources;

wherein the operating apparatus has electrical components arranged in the first end section region of the lamp, and the operating apparatus has at least one further electrical component arranged in the second end section region of the lamp wherein the operating apparatus is a chopper regulator, and the at least one further electrical component of the operating apparatus is at least one inductive component of the chopper regulator, wherein the at least one inductive component is the only electrical component arranged in the second end section region of the lamp.

* * * * *